US007546805B2

(12) United States Patent
Voreck et al.

(10) Patent No.: US 7,546,805 B2
(45) Date of Patent: Jun. 16, 2009

(54) DETONATOR

(75) Inventors: Wallace E. Voreck, Sparta, NJ (US); Wenbo Yang, Sugar Land, NJ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1425 days.

(21) Appl. No.: 10/197,244

(22) Filed: Jul. 17, 2002

(65) Prior Publication Data

US 2003/0019384 A1 Jan. 30, 2003

Related U.S. Application Data

(60) Provisional application No. 60/306,399, filed on Jul. 17, 2001.

(51) Int. Cl.
*C06C 7/00* (2006.01)
*F42C 19/08* (2006.01)

(52) U.S. Cl. ..... 102/204; 102/470; 102/439

(58) Field of Classification Search ..... 102/204, 102/202.5, 202.7, 202.8, 202.14, 275.4, 275.6, 102/275.11, 469, 470, 439
See application file for complete search history.

(56) References Cited

U.S. PATENT DOCUMENTS 3,415,192 A * 12/1968 Stadler et al. ..... 102/204
4,014,264 A * 3/1977 Bendler et al. ..... 102/202.6
4,312,271 A * 1/1982 Day et al. ..... 102/202.13
4,522,665 A * 6/1985 Yates et al. ..... 149/21
4,541,342 A * 9/1985 Routledge ..... 102/308
4,671,177 A * 6/1987 Mayville ..... 102/204
4,735,145 A * 4/1988 Johnson et al. ..... 102/202.5
4,998,477 A 3/1991 Barker
5,088,413 A * 2/1992 Huber et al. ..... 102/202.5
5,123,356 A 6/1992 Brooks et al.
5,291,828 A * 3/1994 Nerheim et al. ..... 102/202
5,481,978 A * 1/1996 Muller et al. ..... 102/470
5,485,788 A * 1/1996 Corney ..... 102/472
5,717,159 A * 2/1998 Dixon et al. ..... 149/40
5,756,925 A * 5/1998 Frank et al. ..... 102/202.7
6,088,655 A 7/2000 Daily et al.

FOREIGN PATENT DOCUMENTS

GB 2038819 * 6/1980

OTHER PUBLICATIONS

Reynolds Industries Systems, Inc., "Special Products", Catalog, p. 16.
Robert H. Dinegar, James O. Johnson, ; "The Anvil Detonator: A 300 C-Stable, Hot-Wire-Ignited, Nonprimary-Explosive Dvice", Article, Jul. 1986, pp. 1-7, 17. , Los Alamos, NM.
Barker, Freak, Mooney and Rayne, "A cool performance in the downhole heat", Article, pp. 23-24.

* cited by examiner

*Primary Examiner*—James S Bergin
(74) *Attorney, Agent, or Firm*—James L. Kurka; Trop, Pruner & Hu, P.C.; Kevin B. McGoff

(57) ABSTRACT

A detonator includes a pyrotechnic material and a first explosive. The pyrotechnic material ignites in response to a percussive impact, and the explosive detonates in response to the ignition of the pyrotechnic material. The detonator may include a plate, and the plate forms a projectile in response to energy released by the ignition of the pyrotechnic material to detonate an additional explosive. A passageway of the detonator may be located between these explosives, and the passageway may include a cross-sectional profile that substantially varies along a path between the explosives.

14 Claims, 2 Drawing Sheets

DETONATOR

This invention claims the benefit under 35 U.S.C. § 119 to U.S. Provisional Application No. 60/306,399, entitled, "DETONATOR," filed on Jul. 17, 2001.

BACKGROUND

1. Field of Invention

This invention relates generally to detonators used in the downhole environment. More particularly, this invention relates to high temperature, non-primary explosive percussion detonators.

2. Description of the Art

A detonator is used in the downhole environment to initiate an explosive reaction for purposes of detonating an explosive device, such as a booster, a detonator cord, or a shaped charge. A detonator is used, for example, to initiate a detonation wave on a detonating cord to fire the shaped charges of a perforating gun.

Some detonators are ignited by an electrical mechanism. Once the detonator is at the appropriate depth in the wellbore, a signal is sent to the electrical mechanism, and the electrical mechanism transmits an electrical charge to the detonator thereby igniting it. Electrically actuated detonators, however, may malfunction when deployed in high temperature wellbores since the electrical components are susceptible to the high temperatures. It would therefore be beneficial to the prior art to provide a detonator that does not include components that are susceptible to the high temperature environments found in wellbores. In addition, electrically actuated detonators may also pose a safety hazard in the presence of specific frequencies of radio waves, since such waves may activate the electrical components and inadvertently ignite the detonator. The prior art would therefore also benefit from a detonator that cannot be inadvertently ignited by radio waves. Primary explosives are very sensitive to electrostatic radio frequency (RF) energy.

Some detonators also utilize very sensitive primary explosives, such as lead azide or silver azide. These primary explosives must be handled extremely carefully and have such great sensitivity that moderate or even slight motion or forces can ignite them. Primary explosives are a safety hazard. Therefore, it would be beneficial to the prior art to provide a detonator that does not include highly sensitive primary explosives.

Detonators used downhole must withstand extremely high temperatures and pressures for prolonged periods of time. Thus, all detonator components should be constructed to withstand such temperatures and pressures.

A conventional detonator may include a constricted constant radius cylindrical passageway between the ignition charge and the output charge. The purpose of this passageway is to enable the deflagration-to-detonation transition and to route this wave from the ignition charge to the output charge. However, detonation waves tend to propagate linearly and tend not to "turn corners" very well. Therefore, the inclusion of the cylindrical passageway in a detonator often times results in an energy decrease in the detonation wave as it attempts to enter and pass through the passageway. The prior art would therefore benefit from a detonator that includes a mechanism for routing the detonation wave from the ignition charge to the output charge without a corresponding loss in detonation wave energy.

Thus, there is a continuing need for an arrangement that addresses one or more of the problems that are stated above.

SUMMARY

In an embodiment of the invention, a detonator includes a pyrotechnic material and an explosive. The pyrotechnic material ignites in response to a percussive impact, and the explosive detonates in response to the ignition of the pyrotechnic material.

In another embodiment of the invention, a detonator includes a pyrotechnic material and a plate. The pyrotechnic material ignites in response to a percussion impact, and the plate forms a projectile in response to energy released by the ignition of the pyrotechnic material to detonate an explosive.

In yet another embodiment of the invention, a detonator includes an explosive, an additional explosive and a passageway that is located between the first and second explosives. The explosive produces a detonation wave, and the passageway routes the detonation wave from the explosive to the additional explosive. A cross-sectional profile of the passageway substantially varies along a path from the explosive to the additional explosive.

Advantages and other features of the invention will become apparent from the following description drawing and claims.

DETAILED DESCRIPTION

Figure 1:
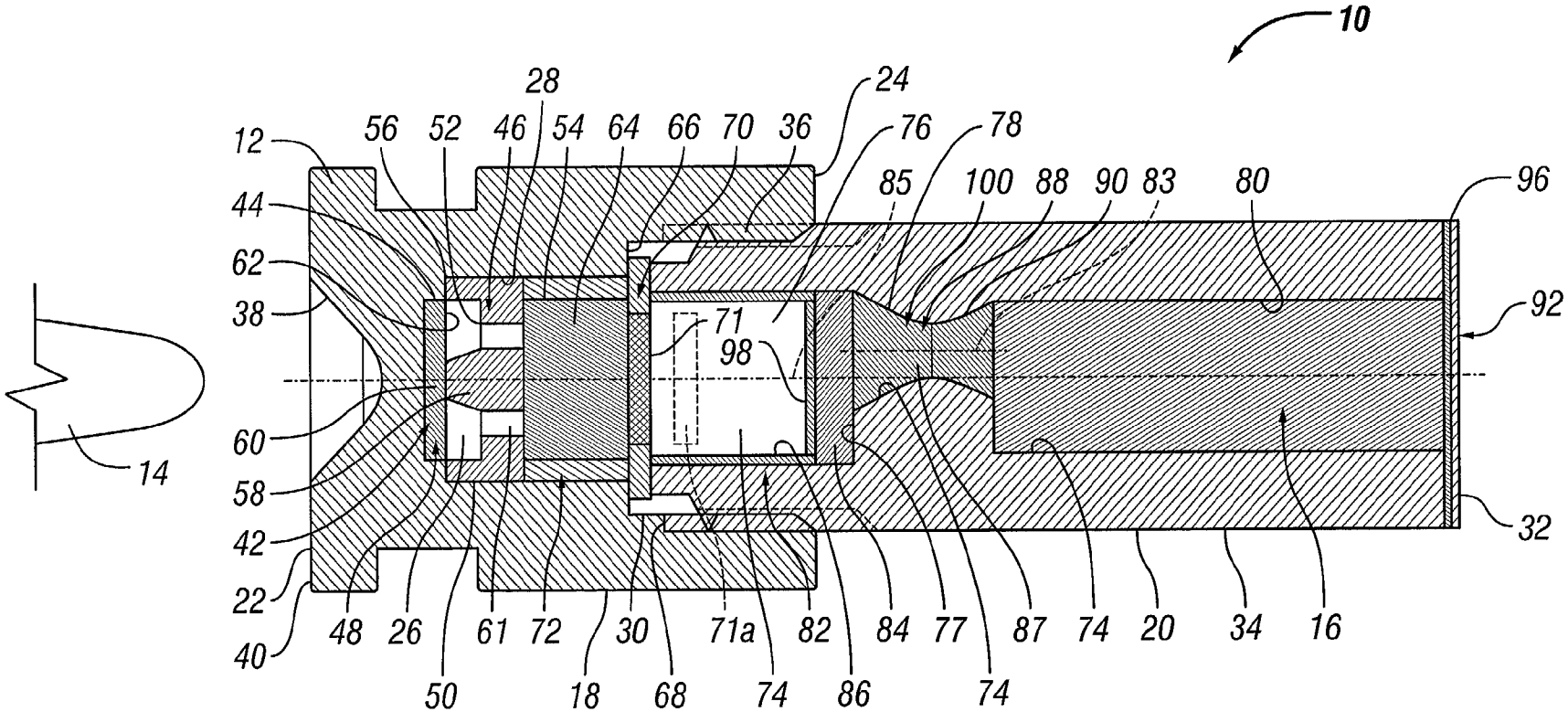
FIGS. 1 and 2 are schematic diagrams depicting a detonator according to different embodiments of the invention.

Referring to FIG. 1, a detonator 10 in accordance with an embodiment of the invention has features that permit the detonator 10 to have a temperature rating of approximately 500° Fahrenheit (F) for 100 hours. This high temperature rating is well suited for downhole applications in a subterranean well.

The detonator 10 generally operates in the following manner to detonate a main explosive 16 of the detonator 10. The detonator 10 is a percussion-type detonator 10 that includes a high temperature-rated percussion primer mix, referred to as a pyrotechnic initiator charge 42 herein. When an external firing pin 14 strikes a housing 12 of the detonator 10, a percussion wave is generated that ignites the pyrotechnic initiator charge 42. The burning of the charge 42, in turn, produces pressure on a first retainer 62. This pressure builds until the first retainer 62 breaks apart to cause communication of the flame (from the burning of the charge 42) to a second pyrotechnic charge 64. In response to this flame, the second pyrotechnic charge 64 begins to burn. The burning of the second pyrotechnic charge, in turn, builds up pressure on a flyer plate 70. The pressure builds up to a point at which the flyer plate 70 shears, thereby creating a projectile 71*a* that travels down a barrel 76 of the detonator 10. The projectile 71*a* accelerates while traveling down the barrel 76 until the projectile 71*a* strikes as second retainer 98 that is disposed at the end of the barrel 76. An explosive pellet 84 is located on the other side of the second retainer 98. Unlike the charges 42 and 64, the explosive pellet 84 is a secondary explosive, and when the projectile 71*a* strikes the second retainer 98, the projectile 71*a* transfer sufficient energy to detonate the pellet 84. The detonation of the explosive pellet 84, in turn, causes the main explosive 16, also a secondary explosive, of the detonator 10 to detonate. The detonator 10 is described in more detail below.

Thus, a series of events leads to the detonation of the main explosive 16 (of the detonator 10). The detonation of the main explosive 16, in turn, may initiate another mechanism (not shown) that is external to the detonator 10, such as a booster, a detonation cord, or a shaped charge, as just a few examples. As described herein, in some embodiments of the invention, the detonator 10 may use secondary explosives and not use any primary explosives. Discussed below are the structure of the detonator 10 and the operation of the detonator 10 according to various embodiments of the invention.

Detonator housing 12 may include a first housing section 18 and a second housing section 20. First housing section 18 may include a first closed end 22 and a second open end 24. A first housing section cavity 26 that extends from the second open end 24 towards the first closed end 22 defines a first housing section interior surface 28. Second housing section 20 may include a first open end 30, a second open end 32, and an exterior surface 34. First housing section 18 and second housing section 20 are selectively attached to each other such as by a threaded connection 36 defined between first housing section interior surface 28 and second housing section exterior surface 34.

Detonator 10 may also include a depression 38 located on the exterior 40 of the first closed end 22 of the first housing section 18. The tip of the firing pin 14 has a smaller angle than the angle of entry of the depression 38 to allow the firing pin 14 to penetrate the closed end 22. In some embodiments of the invention, about 0.055 inches of penetration of the firing pin 14 into the charge 42 may be needed to ignite it. Depression 38 preferably matches the shape of the pin 14 so that a substantial amount of surface area comes into contact when the pin 14 impacts the depression 38 to generate the percussion wave to ignite the pyrotechnic initiator charge 42. As an example, in some embodiments of the invention, the contact end of the pin 14 may have a diameter of approximately 0.05 inches and strike the first housing section 18 with a force over approximately 35 in-lb, a force that dents the first closed end 22 by at least 0.04 inches, in some embodiments of the invention.

In some embodiments of the invention, the tip of the external firing pin 14 has a radius of 0.050 inches and an angle of 60 degrees. The depression 38 may have a radius of 0.093 inches and an entry angle of 90 degrees, in some embodiments of the invention. The exact force that is required to generate the percussion wave depends on the thickness and strength of the closed end 22 and the shape of the firing pin 14. In some embodiments of the invention, the detonator 10 does not fire with less than 20,000 pounds per square inch (psi) of external hydraulic pressure. In some embodiments of the invention, the first housing section 18 may be made from 303 stainless steel, a material that is not pierced by the firing pin 14 and thus, prevents leakage after firing of the detonator 10.

The initiator charge 42 is located within first housing section cavity 26 and may be located intermediate an end surface 44 of first housing section cavity 26 and an anvil section 46. Initiator charge 42 is constructed from a pyrotechnic that can be set off by the percussion impact between pin 14 and depression 38 and that can successfully function at the high temperatures and pressures found in the downhole environment. Thermal stability at high temperatures for prolonged periods of time is desirable. Adequate compositions for initiator charge 42 include the mixture of 47.0% (wt) potassium perchlorate ($KClO_4$) MIL-P217A, class 3; 33.8% (wt) low sulfur antimony sulfide ($Sb_2S_3$) MIL-A159D type 2; and 19.2% (wt) calcium sulfide ($CaSi_2$) UN1405. Other variations of the percentages of these constituents may be made in other embodiments of the invention. This mixture may have fine particle sizes (sizes less than about 44 microns, for example) that are formed by passing the mixture through a 325 mesh screen. Other materials may be used to form the initiator charge 42 in different embodiments of the invention.

An advantage of using perchlorate is its thermal stability in that the above-described mixture has a temperature rating of approximately 510° Fahrenheit (F) for 100 hours. This high temperature rating is well suited for downhole applications in a subterranean well. The charge 42 has a DSC exotherm starting at 570° F.

Initiator charge 42 preferably abuts cavity surface 44 and is disposed within a recess 48. Anvil section 46 includes an exterior surface 50, a first surface 52 proximate the initiator charge 42, and a second surface 54 distal the initiator charge 42. Anvil section exterior surface 50 is preferably in substantial abutment with first housing section interior surface 28. Anvil section 46 also includes an annular extension 56 that extends from the anvil section first surface 52 and abuts the top surface 44. An internal firing pin 58 also extends from the anvil section first surface 52 and is in mechanical communication with the initiator charge 42. The internal firing pin 58 is preferably centered on anvil section first surface 52 and is also preferably conical in shape and includes a distal end 60 that may be flat. In some embodiments of the invention, the internal firing pin 58 has a flat tip 0.05" dia., and an angle of 120 degrees. In some embodiments of the invention, the pin 58 penetrates at least 0.04 inches such as 0.05 inches, for example. In one embodiment, the first retainer 62 is disposed intermediate the initiator charge 42 and the anvil section 46 so that the first retainer 62 abuts the initiator charge 42 on one side and the projection distal end 60 on the other side. The first retainer 62 can be constructed from a number of metallic materials (an aluminum foil or Kapton foil, as examples) that break apart so a flame may go through retainer 62 when the pyrotechnic charge 42 burns. In this manner, the internal firing pin 58 supports first retainer 62 to allow pressure to build up when initiator charge 42 ignites and burns. When the built-up pressure is sufficient, the first retainer 62 breaks up near the internal firing pin 58. Anvil section 46 also includes at least one hole 61 extending from the anvil section first surface 52 to the anvil section second surface 54 for purposes of communicating the flame from the charge 42 to the second charge 64, described below.

Cavity 26 may include a shoulder 66 and an enlarged section 68 extending from the shoulder 66 to first housing section second open end 24. The first flyer plate 70 is constricted against the shoulder 66 by the second housing section first open end 30, which, as previously disclosed, is selectively connected to first housing section interior surface 28. First flyer plate 70 may be constructed from a variety of materials (tantalum, copper or steel, as examples) that permits pressure to build up behind the first flyer plate 70 when the second charge 64 bums for purposes of developing a sufficient force to shear first flyer plate 70 and accelerate the resultant projectile (depicted in FIG. 1 as a broken line box having the reference number 71*a*) at a high speed to detonate another explosive, described below. In some embodiments of the invention, first flyer plate 70 may have a thickness of approximately 0.032 inches and shears with 22,000 psi. The first flyer plate 70 may be made of a high density material, such as tantalum, to prevent loss of strength and shearing at too low a pressure when hot (approximately 500° F., for example). The density of the tantalum is approximately 16.6 gm/cc.

The second charge 64 is disposed between the anvil section 46 and the first flyer plate 70. Second charge 64 may be disposed within a first cylindrical section 72, with the outer surface of the first cylindrical section 72 substantially abutting first housing section interior surface 28. The first cylindrical section 72 holds the second charge 64 in place during manufacture of the detonator 10. Second charge 64 is one that can successfully function at the high temperatures and pressures found in the downhole environment.

In some embodiments of the invention, the charge 42 ignites the charge 64, which bums until the pressure exceeds 20,000 psi, then the flyer plate 70 shears and is accelerated down the barrel 76 until it hits the acceptor explosive pellet 84 and causes it to detonate. Only flame from charge 42 passes through the holes 61 and ignites the charge 64, as the pressure that is generated by charge 42 is very low. As an example, the second charge 64 and explosive pellet 84 may each be a secondary explosive, such as NONA, HNS or HMX, as just a few examples. The use of a secondary explosive is desirable because thermal stability at high temperatures for prolonged periods of time is desirable. In this manner, unlike primary explosives, secondary explosives are generally not capable of being detonated by naturally occurring phenomena. Therefore, the use of secondary explosives (instead of primary explosives) in the detonator 10 significantly decreases the likelihood that the detonator 10 will prematurely detonate. As described below, in some embodiments of the invention, the detonator 10 does not include any primary explosives.

Second housing section 20 includes a cavity 74 from second housing section first end 30 to second housing section second end 32. Cavity 74 may include three portions: the barrel flyer portion 76 through which the first flyer plate 71 accelerates, an intermediate portion 78, and a final portion 80.

Flyer plate portion 76 is preferably cylindrical in shape and includes an explosive pellet 84 distal to second housing section first end 30. Flyer plate portion 76 may also include a second cylindrical portion 82 located intermediate the first flyer plate 70 and the explosive pellet 84, the outer surface of the second cylindrical section 82 substantially abutting the second housing section interior surface 86. The second cylindrical portion 82 holds pellet 84 in place, although in other embodiments of the invention, a retainer 98 (described below) may be used to solely hold the pellet 84 in place.

In an embodiment of the invention, the second retainer 98 is disposed the side of the explosive pellet 84 proximate first flyer plate 70. The second retainer 98 can be constructed from a number of metallic materials (aluminum foil or Kapton foil, as examples).

In some embodiments of the invention, intermediate portion 78 includes a passageway, or opening 87, to communicate a detonation wave from the explosive pellet 84 to main explosive 16 that is contained in the final portion 80. The second housing section 20 includes a shoulder or anvil 77 at the end of the barrel section 76 that abuts the explosive pellet 84. The anvil 77 under the explosive pellet 84 is needed to increase the shock pressure to a high enough level so that the flyer plate 71 detonates the main explosive 16. The anvil 77 includes an opening 87 that is eccentric with respect to the axis of the barrel 86 for purposes of preventing the first flyer plate 71 from blocking the detonation since the flyer plate 71 is curved and strikes the center of the anvil 77 (concentric with the axis of the barrel 76) first.

The cross-sectional profile of the opening 87 varies along a path from the explosive pellet 84 to the main explosive 16 (i.e., the opening is tapered) for purposes of increasing the shock pressure maximizing the capture of the detonation wave that is produced by detonation of the explosive pellet 84 and for purposes of maximizing the transfer of the detonation wave to the main explosive 16. The intermediate portion 78 includes an explosive (a secondary explosive, for example) in the opening 87.

In some embodiments of the invention, the opening 87 has a "venturi-like" shape, including a first frustoconical section 88 decreasing in cross-section from flyer plate portion 76 towards final portion 80 and a second frustoconical section 90 increasing in cross-section from first frustoconical section 88 to final portion 80. In one embodiment, the cross-sectional area of first frustoconical section 88 (at the junction with flyer plate portion 76) is less than the cross-sectional area of flyer plate portion 76, and the cross-sectional area of second frustoconical section 90 (at the junction with final portion 80) is less than the cross-sectional area of final portion 80. In addition, intermediate portion 78 may be eccentric in relation to flyer plate portion 76 final portion 80, as depicted in FIG. 1 with an axis 85 of the flyer plate portion 76 (along which the projectile 71 travels) being eccentric with respect to an axis 83 of the opening 87. This eccentricity allows more surface area to be impacted by the flyer plate portion 76. However, the first 88 and second 90 frustoconical sections may be substantially concentric with each other, in other embodiments of the invention. The opening 87 circumscribes axis 83, and flyer plate portion 76 circumscribes axis 85. The axis 85 may be concentric with the overall longitudinal axis of the detonator 10.

In some embodiments of the invention, first and second frustoconical sections 88 and 90 decrease and increase in cross-sectional area along a gradual gradient of approximately 20° or more relative to their axes. In some embodiments of the invention, the angle of the gradient may be less if the frustoconical section is sufficiently long. First frustoconical section 88 is preferably also slightly longer than second frustoconical section 90. As noted above, intermediate portion 78 may be filled with a second explosive 100, which second explosive 100 is selected so that it can successfully function at the high temperatures and pressures found in the downhole environment. Second explosive 100 may be a secondary explosive that preferably has a low sensitivity and has an output sufficient to detonate the main explosive 16 in response to the detonation of the explosive pellet 84. Thermal stability at high temperatures for prolonged periods of time is desirable. Adequate compositions for second explosive may include NONA, HNS and HMX, as just a few examples.

Final portion 80 is preferably cylindrical in shape and includes the main explosive 16 therein. Preferably, the main explosive 16 within final portion 80 substantially fills the entire final portion 80. Main explosive 16 may be a secondary explosive and may be selected so that it can successfully function at the high temperatures found in the downhole environment, has a low sensitivity, and has an output sufficient to generate a detonation wave on a detonating cord (not shown) using one of the techniques described below. Thermal stability at high temperatures for prolonged periods of time is desirable. Adequate compositions for the main explosive 16 may include NONA, HNS and HMX, as just a few examples.

A second flyer plate 92 may be disposed at the second housing section second end 32. In one embodiment, second flyer plate 92 is held in place in a groove 96 on second housing section interior surface 86 proximate second housing section second end 32. Alternatively, second flyer plate 92 may be releasably held in place at the second housing section second end 32 by mechanisms such as a crimp ring. The flyer plate 92 is important if an air gap is present to detonate the next explosive. Without it, if an air gap is present, it may not detonate.

The detonation wave increases in pressure and duration while propagating through the main explosive 16 to a high enough velocity to detonate the next charge in the explosive train over an air gap. In addition, the flyer plate 92 provides a seal that protects the explosives from contamination and prevents explosive from being lost while the detonator 10 is being transported.

Instead of including a second flyer plate 92, detonator 10 may include a detonation cord lodged within main explosive 16. In this case, the detonation of main explosive 16 triggers the ignition of the detonation cord.

In operation, detonator 10 is typically deployed downhole in conjunction with other tools. Once the tool string has reached the appropriate depth and the operator is ready to activate the detonator 10, the operator may activate a downhole striking pin 14, an activation that causes the pin 14 to travel down the wellbore and eventually collide with the depression of the detonator 10. As an example, the striking pin 14 may be released by a downhole tool in response to a drop bar (dropped from the surface) colliding with the downhole tool, the downhole tool detecting a pressure pulse (communicated from the surface) or a differential in annulus and tubing pressure exceeding a predetermined level. Other variations are possible.

Because the initiator charge 42 is constricted between the anvil section 46 and the cavity top surface 44, the percussion force of the impact between the pin 14 and the depression 38 is transmitted through the first housing section first closed end 22 and into the initiator charge 42. The transmission of force into the initiator charge 42 ignites the initiator charge 42 causing it to burn.

Once ignited, the flames of the burning initiator charge 42 build up pressure until a sufficient force is created to penetrate the first retainer 62 and permit the flames to pass through the holes 61 and act on second charge 64, initiating the burn of second charge 64.

The burn of second charge 64, in turn, generates gas and pressure that act against the first flyer plate 70, which first flyer plate 70 is constricted from moving by second housing section first open end 30. The force acting against first flyer plate 70 causes the first flyer plate 70 to shear off the central section of the first flyer plate 70, and the sheared first flyer plate section 71 is launched within flyer plate portion 76 of cavity 74.

The first flyer plate section 71 soon impacts the explosive pellet 84. Upon impact between the first flyer plate section 71 and the explosive pellet 84, the detonation of the explosive pellet 84 occurs. Since the intermediate portion 78 of cavity 74 is eccentric in relation to the flyer plate portion 76 of cavity 74, the surface area of explosive pellet 84 that is constricted between the first flyer plate section 71 and the flyer plate portion end surface 77 is optimized with respect to density, helping to ensure the detonation of the explosive pellet 84.

In general, the detonation wave begun by the explosive pellet 84 is transmitted through the second explosive 100 that is disposed in the intermediate portion 78 of cavity 74 and into the main explosive 16 that is disposed in the final portion 78 of cavity 74. If a second flyer plate 92 is included in detonator 10, the detonation wave of the main explosive 16 generates pressure and gases which will release the second flyer plate 92 from the groove 96 or crimp ring (for example) and launch it against its intended target (such as a primer cord or booster). If a detonator cord is lodged in main explosive 16, the detonation wave of the main explosive 16 causes the ignition of the detonator cord, which in turn triggers the activation of the intended device (a perforating gun, for example).

Intermediate portion 78 acts to ensure that the detonation wave passes from the explosive pellet 84 to the main explosive 16. Detonation waves tend to propagate linearly and tend not to "turn corners". Thus, since it decreases in cross-sectional area towards the second housing section second end 32, the first frustoconical section 88 acts to receive the detonation wave from the entire explosive pellet 84, and because the frustoconical section 88 increases in cross-sectional area towards the second housing section second end 32, the section 90 acts to allow the detonation wave to expand to sufficiently impact the entire main explosive 16.

Thus, as compared to some conventional detonators, the detonator is percussion actuated instead of electrically actuated. This permits greater thermal boundaries for the detonator 10 because of the absence of electronics. Furthermore, the use of potassium perchlorate for the pyrotechnic charge 42 also permits greater thermal boundaries. The frustoconical sections of the intermediate sections permit more efficient transfer of the detonation wave to the main explosive. Unlike a conventional detonator, the detonator 10 may include secondary explosives and not include primary explosives, a distinction that permits the use of less sensitive explosive, prevents unintentional detonations and provides higher stability for longer periods of time.

Therefore, the advantages of the invention may include one or more of the following. The detonator may not include components that are susceptible to the high temperature environments found in wellbore. The detonator may not be inadvertently ignited by radio waves. The detonator may not include highly sensitive primary explosives. The detonator may not include components that are constructed to withstand extremely high temperatures and pressures for prolonged periods of time. The detonator may include a mechanism for routing the detonation wave from the ignition charge to the output charge without a corresponding loss in detonation wave energy.

Figure 2:
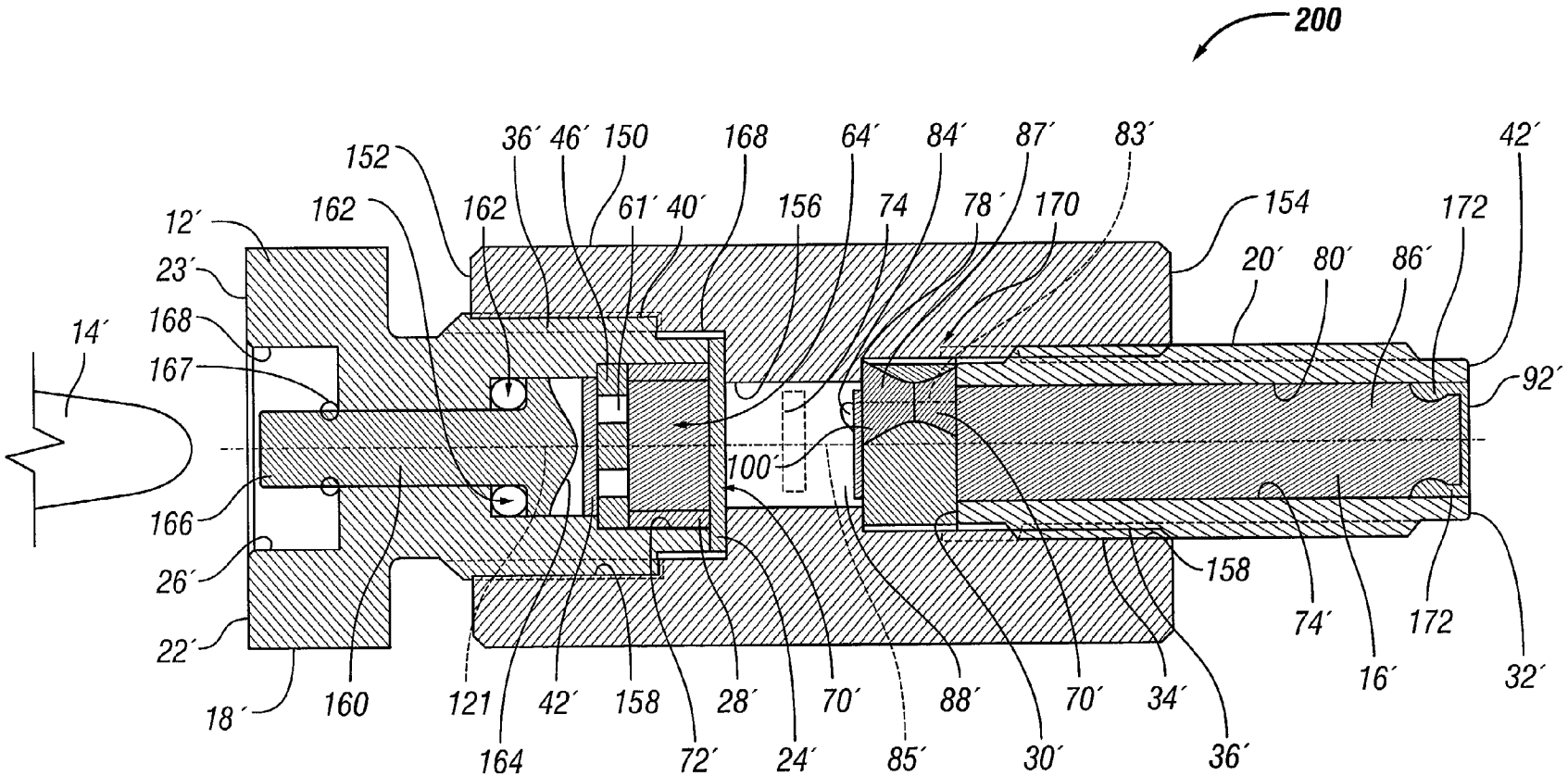

Another embodiment 200 of the detonator in accordance with the invention is depicted in FIG. 2. Components (of the detonator 200) that are similar to the components of the detonator 10 are designated by the suffix "'". In this embodiment, a detonator housing 12' includes a first housing section 18', a second housing section 20', and a third housing section 150. First housing section 18' may include a first open end 22' and a second open end 24', with a first housing section cavity 26' extending therethrough. Second housing section 20' may include a first open end 30' and a second open end 32', with a second housing section cavity 74' extending therethrough. Third housing section 150 may include a first open end 152 and a second open end 154, with a third housing section cavity 156 extending therethrough. First housing section 18' (at second open end 24') and third housing section 150 (at first open end 152) are selectively attached to each other such as by a threaded connection 36' defined between first housing section exterior surface 40' and third housing section interior surface 158. Second housing section 20' (at first open end 30') and third housing section 150 (at second open end 154) are selectively attached to each other such as by a threaded connection 36' defined between second housing section exterior surface 34' and third housing section interior surface 158.

A firing pin 160 is sealingly slidably disposed within first housing section cavity 26'. The firing pin 160 is sealed against the first housing section cavity 26' by a seal 162, such as an O-ring. The seal 162 serves at least two functions, further described below. The firing pin 160 includes an impact end 164 located distal to first housing section first open end 30'. The firing pin 160 also includes a top end 166 that either protrudes from first housing section first end 22' or is located within a recess 168 defined on first housing section first end 22'.

The firing pin 160 may be held initially in place by a snap ring 167, and the firing pin 160 moves forward toward initiator charge 42' with very little force (a force of about 12 in-lb, for example). However, the combination of the firing pin 160 and O-ring 162 forms a Bridgeman seal to prevent leakage when back pressure forces the firing pin 160 against the O-ring 162.

Initiator charge 42' is located within first housing section cavity 26' with a space defined between it and firing pin impact end 164. Initiator charge 42' may include the same types of explosives as the initiator charge 42. Opposite firing pin 160, initiator charge 42' abuts anvil section 46'. Anvil section 46', in this embodiment, is preferably cylindrical in shape with at least one hole 61' defined therethrough.

Third housing section cavity 156 preferably includes a shoulder 168. First flyer plate 70' is constricted against the shoulder 168 by the first housing section second open end 24', which, as previously disclosed, is selectively connected to third housing section interior surface 158. First flyer plate 70' may be constructed from the same types of materials discussed in the previous embodiment.

Second charge 64' is disposed between the anvil section 46' and the first flyer plate 70'. Second charge 64' may be disposed within a first cylindrical section 72', the outer surface of the first cylindrical section 72' substantially abutting first housing section interior surface 28'. Second charge 64' may include the same types of explosives discussed in the previous embodiment.

In this embodiment, second housing section cavity 74' may include an intermediate portion 78' (having first and second frustoconical sections 88' and 90', for example that defines an opening 87') and a final portion 80'. Alternatively, intermediate portion 78' may be included, as shown in the figures, in a separate section 170 that is constricted against a shoulder defined on third housing section cavity 156 by second housing section first end 30'. Explosive pellet 84' is located within third housing section cavity 156 between first flyer plate 70' and intermediate portion 78'. In the embodiment in which intermediate portion 78' is included within second housing section 20', explosive pellet 84' preferably abuts second housing section first end 30'. In the embodiment in which intermediate portion 78' is included within a separate section 170, explosive pellet 84' preferably abuts the separate section 170. Explosive pellet 84' may include the same types of explosives as the explosive pellet 84.

In this embodiment, intermediate portion 78' may be filled with a second explosive 100', as discussed in relation to the previous embodiment.

Second housing section cavity final portion 80' includes main explosive 16' therein, preferably substantially filling the entire final portion 80'. Main explosive 16' may include the same types of explosives as the main explosive 16.

Second flyer plate 92' may be disposed at the second housing section second end 32'. In the embodiment shown in FIG. 2, second flyer plate 92' is held in place by tabs 172 acting against the second housing section interior surface 86'. As in the previous embodiment, instead of including a second flyer plate 92', detonator 10 may include a detonation cord lodged within main explosive 16'. In this case, the detonation of main explosive 16' triggers the ignition of the detonation cord.

The operation of detonator 200 is similar to the operation of detonator 10. Detonator 200 is typically deployed downhole in conjunction with other tools. Once the tool string has reached the appropriate depth and the operator is ready to activate the detonator 200, the operator may activate the striking pin 14' with one of the techniques described above, for example. When activated, the pin 14' collides with the detonator 200, and specifically the firing pin top end 166. The force of the collision causes the firing pin 160 to slide downwardly, making the firing pin impact end 164 impact the initiator charge 42'. The force transmitted to the initiator charge 42' by the firing pin 160 ignites the initiator charge 42' causing it to burn. The seal 162 maintains the pressure that is exerted by the burning initiator charge 42' moving forward, and after detonation of the detonator 20, the seal 162 prevents well bore fluid from flowing inside of the detonator 200 and going up into the firing head.

Once ignited, the flames of the burning initiator charge 42' pass through the holes 61' and act on second charge 64', initiating the burn of second charge 64'. The burn of second charge 64', in turn, generates gas and pressure that act against the first flyer plate 70', which first flyer plate 70' is constricted from moving as previously described. The force acting against first flyer plate 70' causes the first flyer plate 70' to shear off the central section of the first flyer plate 70', and the sheared first flyer plate section 71' is launched through third housing section cavity 156.

The first flyer plate section 71' soon impacts the explosive pellet 84'. Upon impact between the first flyer plate section 71' and the explosive pellet 84', the detonation of the explosive pellet 84' occurs. Since the intermediate portion 78' is eccentric in relation to third housing section cavity 156, the surface area of explosive pellet 84' that is constricted between the first flyer plate section 71' and the separate section 150 to permit capture of the detonation wave by the frustoconical section 88'. The first flyer plate section 71' is optimized with respect to density, helping to ensure the detonation of the explosive pellet 84'.

In the embodiment in which second explosive 100 is included in intermediate portion 78', the detonation wave begun by the explosive pellet 84' is transmitted through the second explosive 100' and into the main explosive 16' that is disposed in the final portion 78'. The detonation wave passes through intermediate portion 78' and into main explosive 16', also causing main explosive 16' to detonate.

If a second flyer plate 92' is included in detonator 10, the detonation wave of the main explosive 16' generates pressure and gases which will release the second flyer plate 92' from the third housing section cavity 156 and launch it against its intended target (such as a primer cord or a detonator). If a detonator cord is lodged in main explosive 16', the detonation wave of the main explosive 16' causes the ignition of the detonator cord, which in turn triggers the activation of the intended device (shaped charges of a perforating gun, for example).

Thus, the detonator 200 has a design in which a firing pin 160 is exposed to the striking pin 14', thereby permitting possibly more reliable detonations than the detonator 10. The open design is sealed off by the seal 162 that both aids in allowing pressure from the burning initiator charge 42' to build up and preventing well fluid from flowing up through the detonator 200 into a firing head (not shown). Other variations in the design of the detonator are possible.

In the preceding description, directional terms, such as "upper," "lower," "vertical" and "horizontal," may have been used for reasons of convenience to describe the detonators 10 and 200 and their associated components. However, such orientations are not needed to practice the invention, and thus, other orientations are possible in other embodiments of the invention.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. A detonator comprising:

a first pyrotechnic material to ignite in response to a percussive impact;

a first retainer to cause a pressure to increase in response to burning of the first pyrotechnic material and rupture in response to the pressure exceeding a threshold;

a plate to respond to the rupturing of the first retainer to form a projectile to detonate a first explosive;

a charge responsive to the rupturing of the first retainer to ignite and generate pressure to form the projectile from the plate.

2. A detonator comprising:

a first pyrotechnic material to ignite in response to a percussive impact;

a first retainer to cause a pressure to increase in response to burning of the first pyrotechnic material and rupture in response to the pressure exceeding a threshold;

a plate to respond to the rupturing of the first retainer to form a projectile to detonate a first explosive;

a second explosive; and a passageway located between the first explosive and the second explosive, the passageway including an opening to route the detonation wave from the first explosive to the second explosive, a cross-sectional profile of the opening substantially varying along a path from the first explosive to the second explosive.

3. The detonator of claim 2, further comprising a housing encasing at least one of the pyrotechnic material, the first explosive and the second explosive, the housing containing the passageway.

4. The detonator of claim 3, wherein the size of the cross-sectional profile initially decreases along the path and then increases.

5. The detonator of claim 3, wherein a first portion of the opening has a frustoconical shape oriented in a first direction; and a second portion of the opening has a frustoconical shape oriented in a second direction different than the first direction.

6. The detonator of claim 5, wherein the first direction is opposite to the second direction.

7. The detonator of claim 2, wherein a radius of curvature of the cross-sectional profile increases at least along part of the path.

8. The detonator of claim 2, wherein a radius of curvature of the cross-sectional profile decreases at least along part of the path.

9. The detonator of claim 2, wherein at least part of the opening has a frustoconical shape.

10. The detonator of claim 9, wherein an angle of tapering of the frustoconical shape is at least approximately twenty degrees.

11. The detonator of claim 2, wherein the opening circumscribes an axis, and the detonation wave propagates from the first explosive along a second axis that is substantially eccentric with respect to the axis circumscribed by the opening.

12. The detonator of claim 2, wherein the opening initially concentrates the detonation wave along the path and then spreads out the detonation wave.

13. A detonator comprising:

a first pyrotechnic material to ignite in response to a percussive impact;

a first retainer to cause a pressure to increase in response to burning of the first pyrotechnic material and rupture in response to the pressure exceeding a threshold;

a plate to respond to the rupturing of the first retainer to form a projectile to detonate a first explosive; and a second pyrotechnic material to ignite in response to the rupture of the retainer and directly produce the pressure to from the projectile from the plate.

14. A detonator comprising:

a first pyrotechnic material to ignite in response to a percussive impact;

a first retainer to cause a pressure to increase in response to burning of the first pyrotechnic material and rupture in response to the pressure exceeding a threshold;

a plate to respond to the rupturing of the first retainer to form a projectile to detonate a first explosive; and a second retainer adapted to be contacted by the projectile to detonate the first explosive.

* * * * *